US006175067B1

(12) United States Patent
Lambert

(10) Patent No.: US 6,175,067 B1
(45) Date of Patent: Jan. 16, 2001

(54) HARMONICA

(76) Inventor: Theresa E Lambert, 110 Gray Ct., Santa Rosa, CA (US) 95404

( * ) Notice: Under 35 U.S.C. 154(b), the term of this patent shall be extended for 0 days.

(21) Appl. No.: 09/499,793

(22) Filed: Feb. 8, 2000

(51) Int. Cl.[7] ..... G10D 7/12
(52) U.S. Cl. ..... 84/377; 84/378
(58) Field of Search ..... 84/377, 378

(56) References Cited

U.S. PATENT DOCUMENTS 4,342,250 * 8/1982 Robjent ..... 84/377
4,502,362 * 3/1985 Zacharias ..... 84/377
5,367,937 * 11/1994 Epping ..... 84/377
5,739,446 * 4/1998 Bahnson ..... 84/377

* cited by examiner

*Primary Examiner*—Jeffrey Donels
*Assistant Examiner*—Shih-yung Hsieh

(57) ABSTRACT

A harmonica comprising an integral design of a single molded body as well as a reed fastening system providing releasable attachment of said reed.

1 Claim, 4 Drawing Sheets

HARMONICA

BACKGROUND OF THE INVENTION

The present invention relates to musical instruments, and most particularly to harmonicas. One form of the harmonica is a ten-hole diatonic, another is the chromatic. The harmonica commonly has a plurality of reeds overlying slots in the reed plate. Currently the reed plate is either nailed or held with screws to a wood comb, which provides the sound chambers underlying the slots and reeds. Or the reed plate is screw mounted into a pocket molded into the plastic comb, which houses the reed plate thus aligning the slots and reeds over the sound chambers.

Reed plates are currently constructed of metal, such as brass or steel. Reeds are commonly made of brass and are held in place by a rivet to the reed plate.

A cover plate then protects the instrument. The cover plate is either nailed to the wooden comb or held on with screws to the plastic comb. In each instance it is nailed or screwed threw a hole also placed in the reed plate and comb.

The harmonica is played by blowing breath or drawing air into the sound chamber. This action moves the air around the reed in the slot, thus activating it to vibrate and creating tones associated with this instrument.

A problem with this type of construction is that it provides no protection from the deteriorating effects associated with playing the harmonica due to the caustic properties of human saliva, which enters into the harmonica when blown into. This deterioration results in rust formation, erosion and pitting on the reed plates as well as on the reeds. In the case of the wooden comb there is also the swelling of the wood from this moisture and then the shrinking as it dries. The result is the warping of the comb the reed plates are attached to.

The resulting problems are:

1. A loss of air tightness within the sound chamber due to changes in the fitting of the reed plate to the comb from the corrosive properties of human saliva, resulting in rendering the harmonica unplayable.
2. A loss of air tightness due to the wooden comb warping from moisture induced swelling and then shrinking. This creates a lack of air tightness between the reed plate and comb.
3. A reed failing due to the corrosive properties of human saliva, resulting in an unresponsive reed, thus rendering the harmonica unusable.
4. Currently the only solutions to these construction problems are to either buy a new harmonica, or, where available and applicable, buy an entire set of reed plates and install them.

Prior art has not addressed the problems associated with this type of construction as detailed above.

An object of this invention is to provide a consistently airtight harmonica.

Another object of this invention is to provide an improved comb/reed plate fit within the harmonica that is less susceptible to the corrosive properties of human saliva.

A further object of this invention is an improved reed fastening system whereby the harmonica player can easily change an individual reed without altering the air tightness of the sound chambers.

A still further object of this invention is to provide an overall improved harmonica.

These objects and advantages of my invention will become apparent as the Detailed Description of the Invention proceeds.

BRIEF SUMMARY OF THE INVENTION

The improved harmonica construction of the present invention provides maximum airtight sounding chambers by implementing a solid, molded and adhered placement of the reed plates and comb together, as opposed to being screwed or nailed together as is currently used in harmonica manufacturing. This improved construction directs the wind/air used to activate a reed solely around the reed with no loss of air moving under or out of the sound chamber via between the reed plate and comb.

The improved harmonica construction of this invention also addresses the need of the harmonica player to change only one reed at a time. In one embodiment a threaded reed fastener plate has been constructed into the harmonica invention. Harmonica players can simply unscrew/screw a reed to replace it.

In another embodiment the reed fastener plate is removable with applied pressure. A rivet is used to hold the reed in place. The entire reed fastener plate can be easily replaced, or if desired the player can replace the damaged reed only. With the use of a rivet tool, a reed can easily be removed and the repair made with out affecting the airtight relationship within the sound chamber.

DETAILED DESCRIPTION OF THE INVENTION

Figure 1:
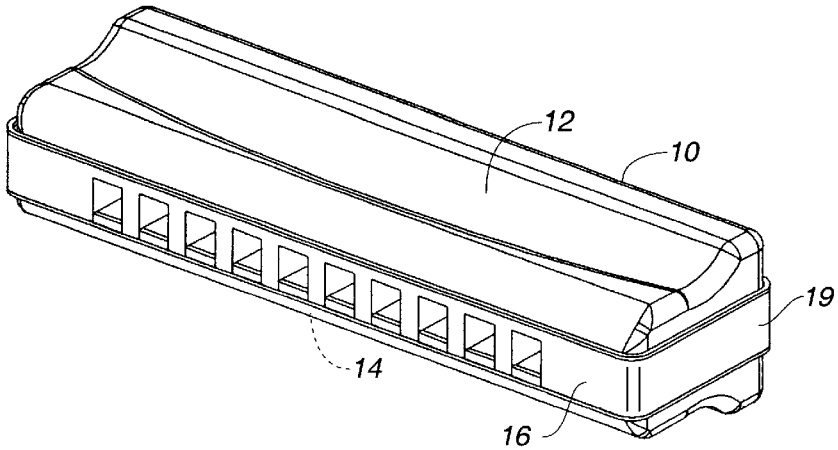
FIG. 1 is an angled isometric front view of the harmonica invention completely assembled.
Figure 2:
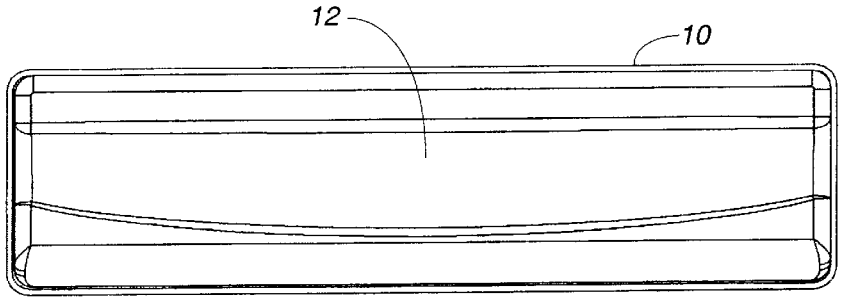
FIG. 2 is a top isometric view of the harmonica invention, the bottom being a mirrored and flipped image.
Figure 3:
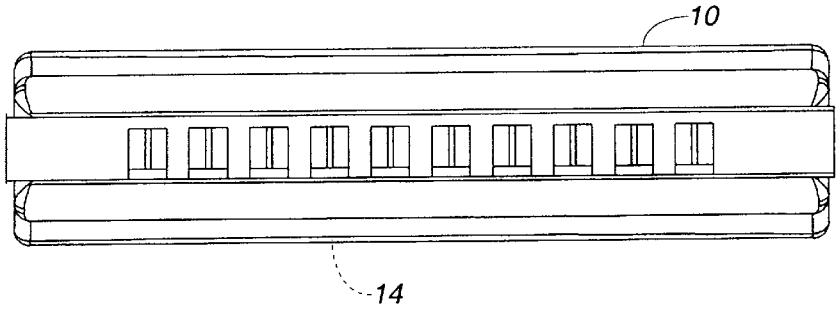
FIG. 3 is a straight front isometric view of the preferred embodiment of the invention.
Figure 4:
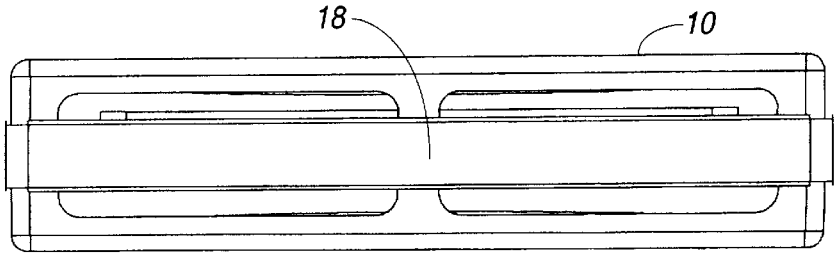
FIG. 4 is a rear isometric view of the harmonica invention.
Figure 5:
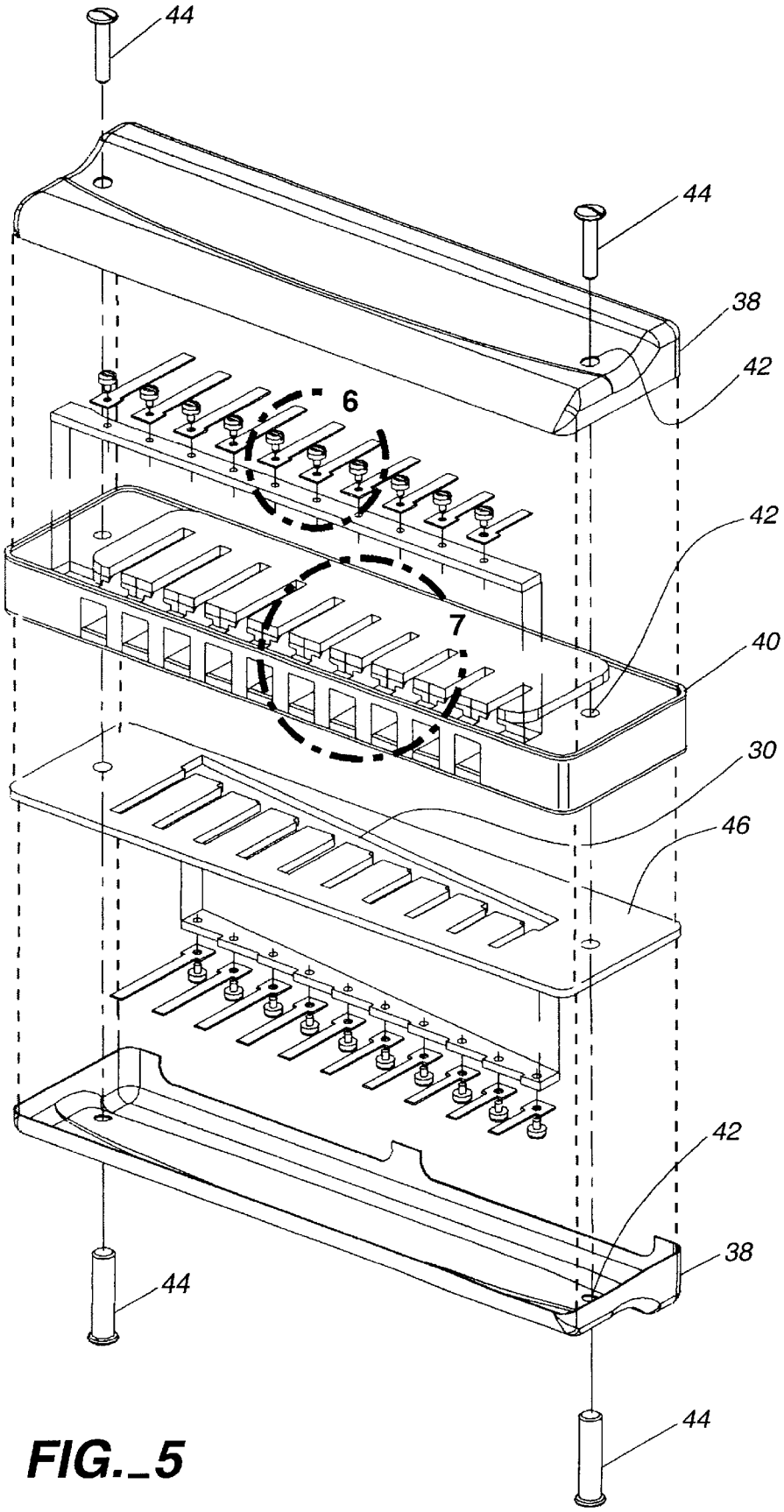
FIG. 5 is an isometric exploded assembly view of a preferred embodiment of the invention showing a frontal view of the harmonica showing the top and bottom reed fastener plates uninstalled, and the top reed slots molded into the comb.

Referencing the figures, the harmonica 10 of this invention has four planes of interest. A top and bottom plane 12,14 where the reeds are positioned. The front 16 provides access to the sound chambers 34 where air is blown or drawn into the instrument to activate the reeds 20 positioned on the top and bottom 12,14, and a rear 18 providing the rear walls of the internal sound chambers.

Figure 8:
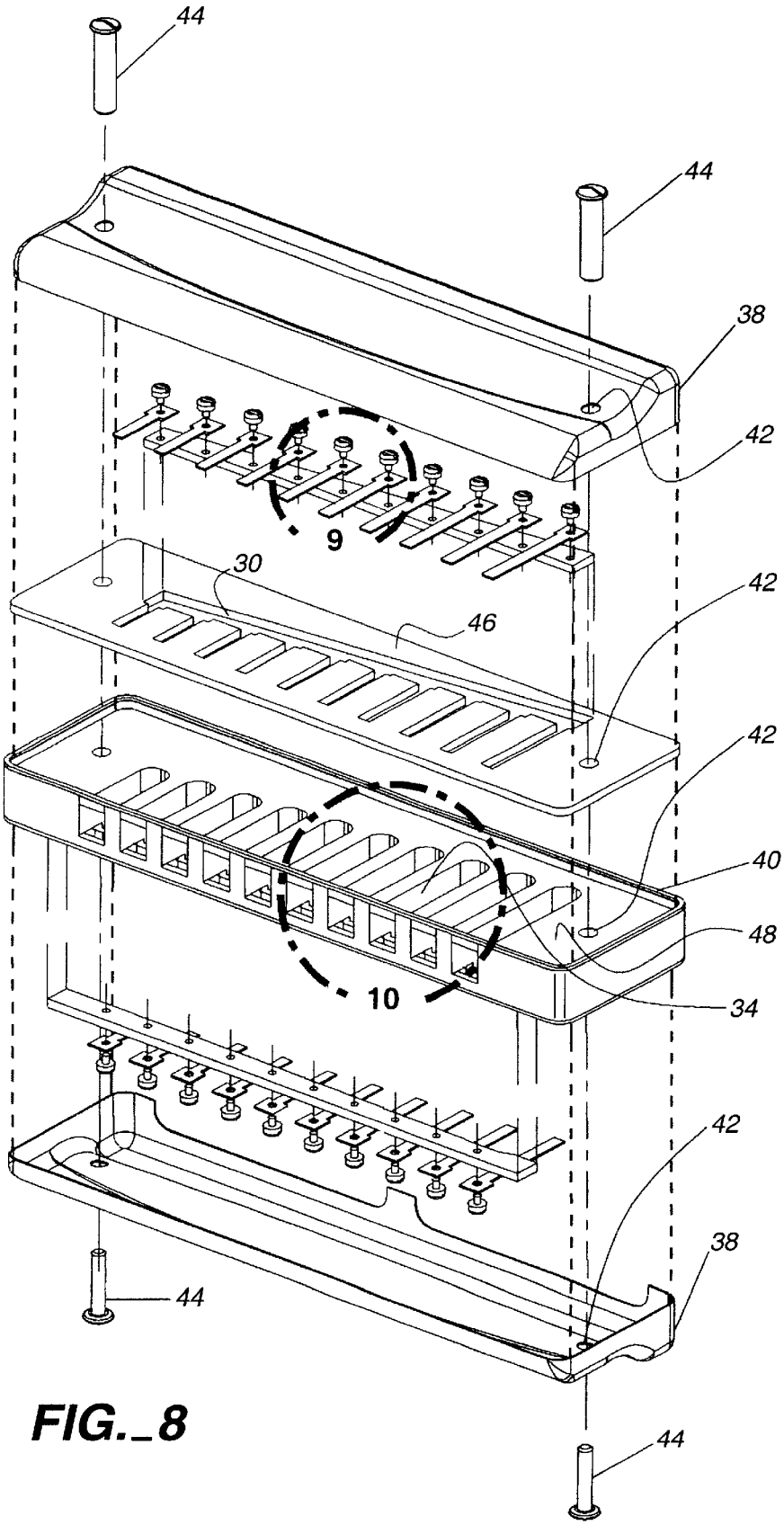
FIG. 8 is an isometric exploded assembly view of the preferred embodiment of the invention showing a bottom/front view of the harmonica invention with the bottom reed housing plate before being permanently affixed to the comb, as well as the uninstalled bottom and top reed fastener plates.

The harmonica of this invention has a new molded body 19 consisting of reed slots 28, two reed fastener plate-housing slots 30, nine internal sound chamber dividing walls 32, and twenty wind baffles 36. This new molded body provides maximum air tightness by providing a molded relationship between the reed slots 28 and the sound chambers 34. As seen in FIG. 8 the bottom reed slots as well as the bottom reed fastener plate-housing slot 30 are molded into a separate piece, the bottom reed housing plate 46, and adhered into the bottom reed housing plate pocket 48 upon final assembly.

The molded material of the preferred embodiment may be plastic. The molded material of another preferred embodiment would be wood composite. The molded material of the highly preferred embodiment would be a ceramic composite. These materials provide the resistance to corrosion and swelling necessary to maintain an improved airtight relationship between reed slots 28 and the sound chambers 34.

Figure 6:
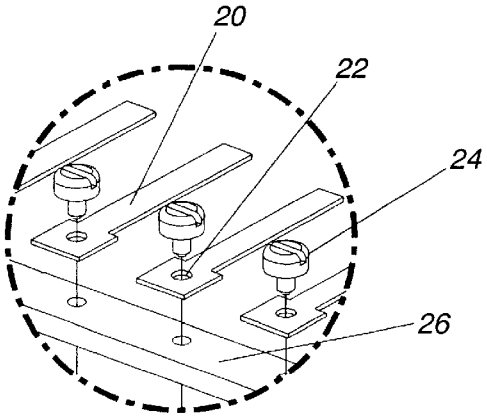
FIG. 6 is an enlarged detailed isometric view of a portion of the top reed fastener plate from FIG. 5 illustrating the mounting of reeds to the reed fastener plate of the harmonica invention.
Figure 9:
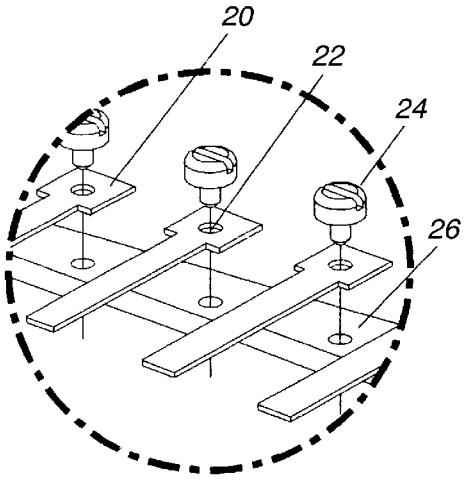
FIG. 9 is an enlarged detailed isometric view of a portion of the bottom reed fastener plate from FIG. 8 illustrating the mounting of the reeds to the reed fastener plate of the harmonica invention.

FIG. 6 and FIG. 9, enlarged detailed isometric views, demonstrate the improvement in this invention of reeds 20 fastened to the metal reed fastener plate 26 with a screw or rivet 24, providing the player with the ability to easily change an individual reed 20. The screw 24 holds the reed in place as the screw moves through the clearance hole 22 that is provided in the reed 20 and threads into the metal reed fastener plate 26 securing the reed tightly in place.

When a rivet 24 is used, it securely holds the reed in place by nature of its finished composition when it moves through the clearance holes 22 in the reed 20 and metal reed fastener plate 26. To change a reed 20 when a rivet 24 is used, the metal reed fastener plate 26 is removed for easy access to the reed 20.

Figure 7:
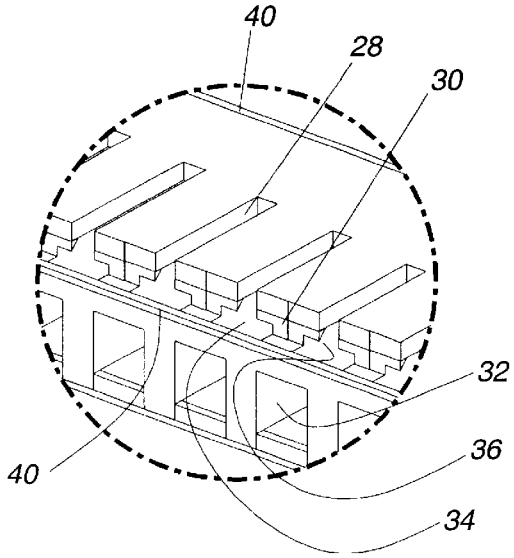
FIG. 7 is an enlarged detailed isometric view of the top reed fastener plate housing from FIG. 5 molded into the comb showing its relationship to the reed slots and to the sound chamber of the harmonica invention.

In FIG. 7 the enlarged detailed isometric view of the top/front plane of the molded body, demonstrates the attention to air tightness that this invention offers. FIG. 7 shows that the reed slots 28 on the top plane of the harmonica of this invention are newly molded into the body itself. Wind baffles 36 are provided in the top reed slots 28 ensuring a consistent airtight relationship at the entry point of the reeds 20 into the sound chamber 34. The metal reed fastener plate 26 sits in the molded reed fastener plate-housing slot 30 thus providing center alignment for the reed 20 with the reed slot 28. On this plane the reeds 20 are fastened at the front of the harmonica onto the metal reed fastener plate 26 with the free vibrating end in the rear of the sound chamber 34. Blowing into the sound chamber 34 activates the reeds 20 on this plane.

Figure 10:
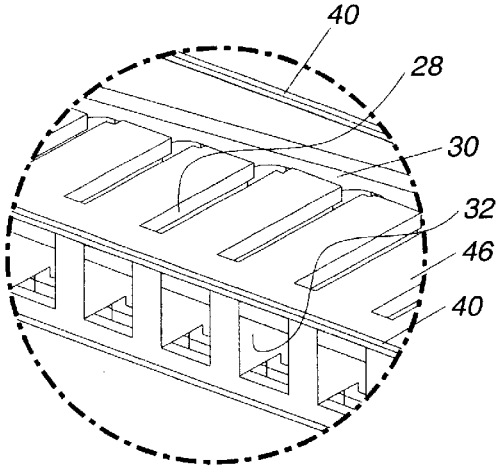
FIG. 10 is an enlarged assembled detailed isometric view of the bottom reed housing plate FIG. 8 assembled into the harmonica of invention showing the relationship of the reed slots and reed fastener plate-housing slot to the sound chamber.

FIG. 10 provides an enlarged detailed assembled isometric view of the bottom/front plane of the harmonica of invention. As with FIG. 7, the airtight relationship between the sound chamber 34 and reed slot 28 is maintained. The metal reed fastener plate 26 sits in the molded reed fastener plate-housing slot 30 thus providing center alignment for the reed 20 with the reed slot 28. On this plane the reeds 20 are fastened at the back of the harmonica onto the metal reed fastener plate 26 with the free vibrating end at the front and above the sound chamber 34. Drawing air into the sound chambers 34 activates the reeds on this plane.

The entire invention is then protected with cover plates 38, which are held in place by two screws 44. The cover plate screws are aligned through the cover plate clearance holes 42 by moving through the molded body and secured at the opposite end with a nut or a threaded sleeve enclosure. The cover plate 38 sits behind the cover plate-housing wall 40 ensuring air tightness between the cover plate 38 and the respective top/bottom planes of the harmonica of the invention.

LEGEND

10. Harmonica
12. Top Plane
14. Bottom Plane
16. Front Plane
18. Rear Plane
19. Molded Body
20. Reed
22. Clearance Hole
24. Screws or Rivet
26. Metal Reed Fastener Plate
28. Reed Slots
30. Reed Fastener Plate Housing Slot
32. Internal Sound Chamber Dividing Walls
34. Sound Chamber
36. Wind Baffle
38. Cover Plate
40. Cover Plate Housing Wall
42. Cover Plate Clearance Holes
44. Cover Plate Screws
46. Bottom Reed Housing Plate
48. Bottom Reed Housing Plate Pocket

What I claim as my invention is:

1. A harmonica comprising: an integrally molded body with sound chambers and a plurality of reed housing slots; a reed plate with an elongate slot; an elongate reed fastener plate shaped to fit into said elongate slot; a plurality of reeds removably fastened to said reed fastener plate; said body, said reed plate, said reed fastener plate with said plurality of reeds, and cover plates are assembled together by screws.

* * * * *